US010586636B2

(12) United States Patent
Han et al.

(10) Patent No.: US 10,586,636 B2
(45) Date of Patent: Mar. 10, 2020

(54) RARE EARTH MAGNET AND MOTOR INCLUDING THE SAME

(71) Applicant: LG Innotek Co., Ltd., Seoul (KR)

(72) Inventors: Jong Soo Han, Seoul (KR); Seok Bae, Seoul (KR); Hee Jung Lee, Seoul (KR); Jai Hoon Yeom, Seoul (KR); Sang Won Lee, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 672 days.

(21) Appl. No.: 15/014,581

(22) Filed: Feb. 3, 2016

(65) Prior Publication Data

US 2016/0225499 A1 Aug. 4, 2016

(30) Foreign Application Priority Data

Feb. 3, 2015 (KR) ..... 10-2015-0016909

(51) Int. Cl.

| | |
|---|---|
| ***H01F 1/057*** | (2006.01) |
| ***H01F 41/02*** | (2006.01) |
| ***C22C 28/00*** | (2006.01) |
| ***C22C 38/00*** | (2006.01) |
| ***C22C 19/07*** | (2006.01) |

(52) U.S. Cl.

CPC ..... *H01F 1/057* (2013.01); *C22C 19/07* (2013.01); *C22C 28/00* (2013.01); *C22C 38/002* (2013.01); *C22C 38/005* (2013.01); *H01F 41/026* (2013.01)

(58) Field of Classification Search

None

See application file for complete search history.

(56) References Cited

U.S. PATENT DOCUMENTS

| | | | | |
|---|---|---|---|---|
| 5,876,518 | A | 3/1999 | Hasegawa et al. | |
| 2001/0030590 | A1* | 10/2001 | Nishiuchi ..... | H01F 41/026 335/302 |
| 2005/0028890 | A1 | 2/2005 | Sakaki et al. | |
| 2011/0095855 | A1* | 4/2011 | Kuniyoshi ..... | H01F 1/0577 335/302 |

FOREIGN PATENT DOCUMENTS

| | | | |
|---|---|---|---|
| CN | 1249521 | A | 4/2000 |
| CN | 1618108 | A | 5/2005 |
| EP | 1024506 | A1 | 8/2000 |
| EP | 1467385 | A1 | 10/2004 |
| JP | 2000133541 | A | 5/2000 |

OTHER PUBLICATIONS

Li, Electrochimica Acta, vol. 123, p. 325-331. (Year: 2014).*

(Continued)

*Primary Examiner* — Xiaowei Su

(74) *Attorney, Agent, or Firm* — Saliwanchik, Lloyd & Eisenschenk

(57) ABSTRACT

A rare earth magnet and a motor including the same are provided. The rare earth magnet is based on an R—Fe—B alloy (R represents at least one rare-earth element comprising Y), wherein a plating layer of the element Co is formed on a surface of the rare earth magnet by an electroplating method.

14 Claims, 7 Drawing Sheets

(56) References Cited

OTHER PUBLICATIONS

Haavisto, Tampere University of Technology, Publication 1180, Nov. 2013. (Year: 2013).*
Samal, J. Vac. Sci. Technol. B 32(1), 2014, No. 011206. (Year: 2014).*
European Search Report dated Jun. 15, 2016 in European Application No. 16153953.1.
Office Action dated Apr. 1, 2019 in Chinese Application No. 201610077517.X, along with its English Translation.
Samal, N. et al., "Low-temperature (≤150° C.) chemical vapor deposition of pure cobalt thin films," *J. Vac. Sci. Technol. B*, Jan./Feb. 2014, 32(1):1-6, American Vacuum Society.

* cited by examiner

RARE EARTH MAGNET AND MOTOR INCLUDING THE SAME

CROSS-REFERENCE TO RELATED APPLICATION

This application claims the benefit under 35 U.S.C. § 119 of Korean Patent Application No. 2015-0016909, filed Feb. 3, 2015, which is hereby incorporated by reference in its entirety.

BACKGROUND

1. Field of the Invention

The present invention relates to a rare earth magnet and a motor including the same, and more particularly, to a rare earth magnet used in motors for various electrical and electronic systems such as automobiles, computers, mobile phones, etc. and sound systems such as speakers, earphones, etc., and a motor including the same.

2. Discussion of Related Art

In general, there is a great demand for a neodymium (Nd)-iron (Fe)-boron (B)-based sintered permanent magnet as a rare earth magnet having a high energy product and a high coercive force. However, the sintered permanent magnet has a problem in that it has poor corrosion resistance since it includes the rare-earth element Nd and Fe, which are easily oxidizable, as major components.

To solve the above problems, methods of forming various protective layers on surfaces of the sintered permanent magnet have been proposed. Here, the protective layers are coated with a metal or a resin layer alone or in a combination thereof. In this case, various methods such as wet plating (e.g., electroplating, etc.), dry plating (e.g., sputtering, ion plating, vacuum deposition, etc.), dip coating, hot dip coating, electrodeposition coating, etc. have been used as a method of forming a film.

In the case of the electroplating, an electric current converges on an edge region of a product, and a relatively small amount of the electric current flows in a central region of the product, and thus the product may be formed so that a thickness of the coated edge region is 1.5 to 5 times a thickness of the coated central region. In this way, since the product is produced based on the thickness of the coated edge region to adjust the size of the product, the thickness of the coated central region becomes relatively thin, resulting in an increase in error rate of the products when commercialized. In particular, such a problem becomes more severe for pipe-type products having a narrow inner diameter.

Also, the crystals of an electroplated layer may grow in a direction perpendicular to a surface of a permanent magnet, and there may be pin holes in a plating layer due to huge crystal grains, resulting in degraded corrosion resistance.

BRIEF SUMMARY

The present invention is directed to providing a rare earth magnet having improved magnetic characteristics. Also, the present invention is directed to providing a rare earth magnet capable of improving high-temperature demagnetization performance in which the magnetic characteristics are degraded at a high temperature, and a motor including the same.

One aspect of the present invention provides a rare earth magnet based on an R-iron (Fe)-boron (B) alloy (R represents at least one rare-earth element including Y). Here, a plating layer of the element Co may be formed on a surface of the rare earth magnet by an electroplating method.

In this case, the plating layer may contain the element Co at a content of 98% by weight or more.

The plating layer of the element Co may have a thickness of 10 μm to 45 μm.

The plating layer of the element Co may be formed by applying a direct current power source to a Co plating solution and subjecting the rare earth magnet to surface treatment.

A ratio of a magnetic field to a coercive force of the rare earth magnet may be greater than or equal to 0.85.

BRIEF DESCRIPTION OF THE DRAWINGS

The above and other objects, features and advantages of the present invention will become more apparent to those of ordinary skill in the art by describing in detail exemplary embodiments thereof with reference to the attached drawings, in which.

DETAILED DESCRIPTION

Figure 1:
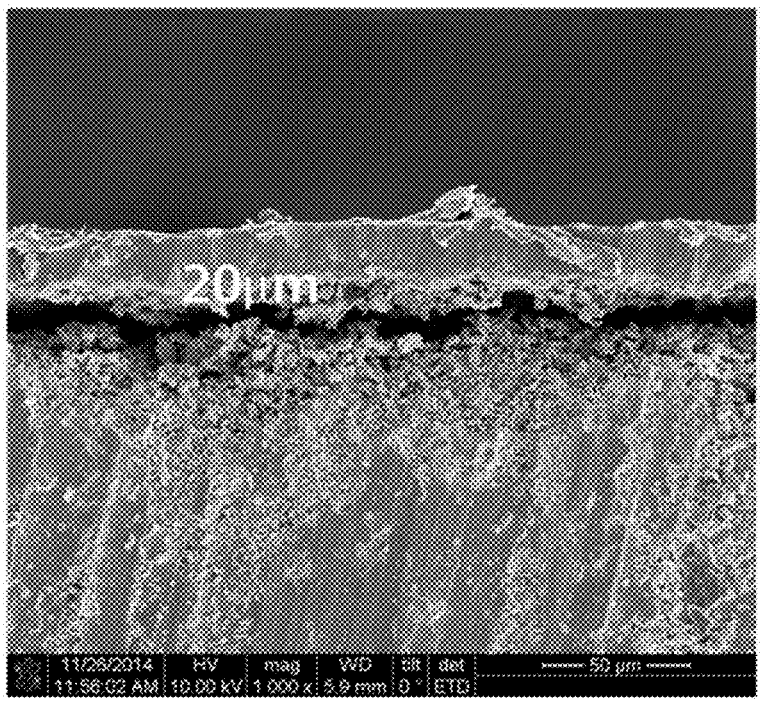
FIG. 1 shows a scanning electron microscope (SEM) image of a plating layer according to one exemplary embodiment of the present invention.

Hereinafter, exemplary embodiments of the present invention will be described in detail. However, the present invention is not limited to the embodiments disclosed below, but can be implemented in various forms. The following embodiments are described in order to enable those of ordinary skill in the art to embody and practice the present invention.

Although the terms first, second, etc. may be used to describe various elements, these elements are not limited by these terms. These terms are only used to distinguish one element from another. For example, a first element could be termed a second element, and similarly, a second element could be termed a first element, without departing from the scope of exemplary embodiments. The term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

The terminology used herein is for the purpose of describing particular embodiments only and is not intended to be limiting of exemplary embodiments. The singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, components and/or groups thereof, but do not preclude the presence or addition of one or more other features, integers, steps, operations, elements, components and/or groups thereof.

With reference to the appended drawings, exemplary embodiments of the present invention will be described in detail below. To aid in understanding the present invention, like numbers refer to like elements throughout the description of the figures, and the description of the same elements will be not reiterated.

The rare earth magnet according to exemplary embodiment of the present invention is based on an R-iron (Fe)-boron (B) alloy (R represents at least one rare-earth element including Y), wherein a plating layer of the element Co is formed on a surface of the rare earth magnet by an electroplating method.

The rare earth magnet may be configured to include the element R, iron (Fe), and boron (B), and may be mainly composed of an R—Fe—B-based alloy. The element R includes the rare-earth element Y. Here, Y may include at least one element selected from the group consisting of scandium (Sc), yttrium (Y), lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), and lutetium (Lu).

The rare earth magnet according to one exemplary embodiment of the present invention may have a structure including a main phase having a tetragonal crystal structure, an R-rich phase in which the rare-earth element R is present at a high blending ratio in a grain boundary region of the main phase, and a boron-rich phase in which boron atoms are present at a high blending ratio. The R-rich phase and the boron-rich phase are non-magnetic phases having no magnetism. Such a non-magnetic phase may, for example, be included at a content of 0.5 to 50% by weight, based on 10% by weight of the magnetic body. Also, the main phase may, for example, be configured to have a particle diameter of approximately 1 to 100 μm.

The content of R may be in a range of 8 to 40 atom %, based on the total content of the rare earth magnet. When the content of R is less than 8 atom %, the crystal structure of the main phase may be converted into substantially the same crystal structure as a iron, resulting in reduced intrinsic coercive force (ihc). When the content of R is greater than 40 atom %, the R-rich phase is excessively formed, resulting in reduced residual flux density (Br).

Also, the content of Fe may be in a range of 42 to 90 atom %, based on the total content of the rare earth magnet. The residual flux density may be reduced when the content of Fe is less than 42 atom %, whereas the intrinsic coercive force may be reduced when the content of Fe is greater than 90 atom %.

The content of B may be in a range of 2 to 28 atom %. When the content of B is less than 2 atom %, a rhombohedral structure tends to be formed, and the intrinsic coercive force may be reduced. When the content of B is greater than 28 atom %, the boron-rich phase may be excessively formed, resulting in reduced residual flux density.

In the magnetic body, some of the B may be substituted with an element such as carbon (C), phosphorus (P), sulfur (S), or copper (Cu). When some of the B is substituted as described above, it is easy to prepare the rare earth magnet, and a decrease in manufacturing costs may also be facilitated. In this case, the amount of these substituted elements has no substantial influence on magnetic characteristics, and thus may be maintained at a content of 4 atom % or less, based on the total amount of the constituent atoms.

In addition, the rare earth magnet may be configured to include an element such as aluminum (Al), titanium (Ti), vanadium (V), chromium (Cr), manganese (Mn), bismuth (Bi), niobium (Nb), tantalum (Ta), molybdenum (Mo), tungsten (W), antimony (Sb), germanium (Ge), tin (Sn), zirconium (Zr), nickel (Ni), silicon (Si), gallium (Ga), copper (Cu), or hafnium (Hf) in addition to each of the above-described elements in view of improving the intrinsic coercive force and facilitating a decrease in manufacturing costs. Also, the amount of these added elements has no substantial influence on the magnetic characteristics, and thus may be maintained at a content of 10 atom % or less, based on the total amount of the constituent atoms. In addition, oxygen (O), nitrogen (N), carbon (C), calcium (Ca) and the like are components that may be assumed to be inevitably mixed in, and may be maintained at a content of approximately 3 atom % or less, based on the total amount of the constituent atoms.

Figure 2:
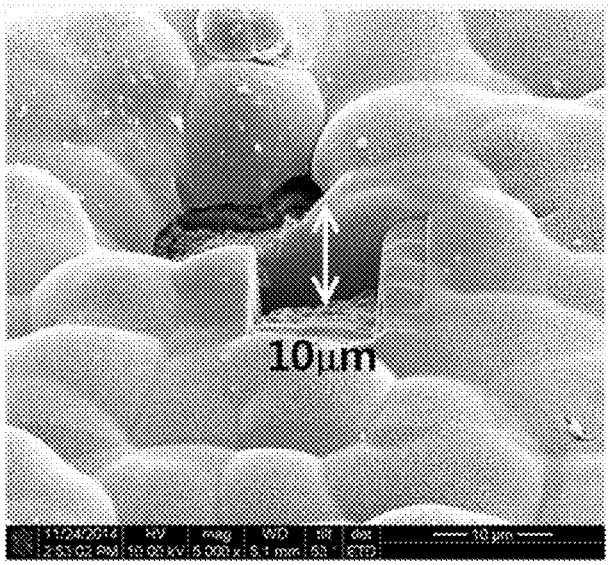
FIG. 2 shows an image of a focused ion beam (FIB) system in the plating layer according to one exemplary embodiment of the present invention.

FIG. 1 shows a scanning electron microscope (SEM) image of a plating layer according to one exemplary embodiment of the present invention, and FIG. 2 shows an image of a focused ion beam (FIB) system in the plating layer according to one exemplary embodiment of the present invention.

The plating layer is formed of the element Co, and surrounds some or all of a surface of the rare earth magnet. An element content of the element Co constituting the plating layer may be greater than or equal to 98% by weight. Here, the plating layer may include other impurities that are inevitably mixed in. The thickness of the plating layer may be in a range of 10 μm to 45 μm.

The plating layer may be formed by applying a direct current power source to a Co plating solution to subject the rare earth magnet to surface treatment.

Figure 3:
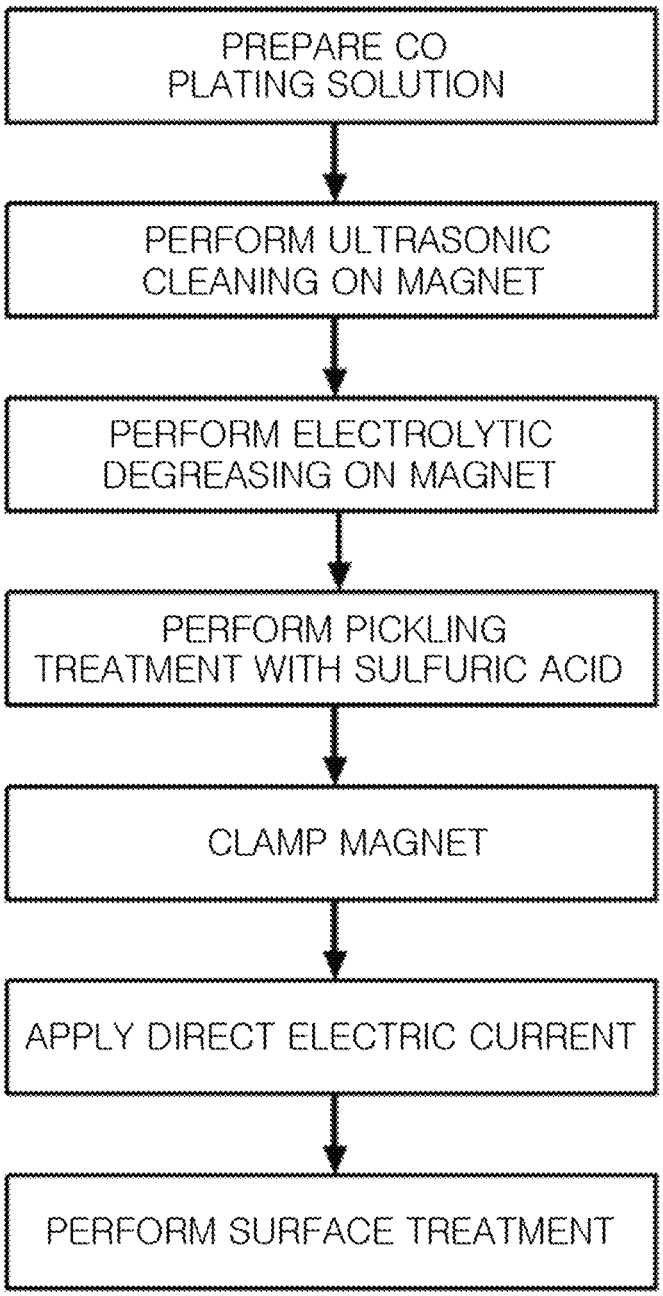
FIG. 3 is a diagram for describing a method of forming the plating layer according to one exemplary embodiment of the present invention.

FIG. 3 is a diagram for describing a method of forming the plating layer according to one exemplary embodiment of the present invention.

Referring to FIG. 3, first of all, a Co plating solution is prepared as a material used to form the plating layer.

Next, a surface of an R—Fe—B-based rare earth magnet may be subjected to ultrasonic cleaning to remove insoluble materials or residual acid components. The ultrasonic cleaning may, for example, be performed using a NaCN solution.

Thereafter, electrolytic degreasing is performed on the R—Fe—B-based rare earth magnet using an electrolysis device.

Subsequently, a pickling treatment is performed to flatten an uneven surface of the R—Fe—B-based rare earth magnet or remove impurities attached to the surface of the R—Fe—B-based rare earth magnet. The pickling treatment may, for example, be performed using sulfuric acid.

Then, the R—Fe—B-based rare earth magnet is immersed in an electrolyte solution containing ions of the Co plating solution, and then fixed. In this case, when the Co plating solution is used as an anode and the R—Fe—B-based rare earth magnet is used as a cathode to apply a direct electric current, the ions of the Co plating solution are attached to a surface of the R—Fe—B-based rare earth magnet to form a plating layer.

TABLE 1

| Coating types | Temp (° C.) | Br (kG) | HcJ (kOe) | (BH) max | Hk (kOE) | Hk/HcJ (%) |
|---|---|---|---|---|---|---|
| Example 1 | 20 | 12.95 | 19.83 | 38.47 | 17.07 | 86.1 |
| Comparative Example 1 | 20 | 12.74 | 19.35 | 38.11 | 15.66 | 80.9 |
| Comparative Example 2 | 20 | 12.43 | 19.88 | 36.11 | 15.72 | 79.1 |
| Example 2 | 80 | 12.26 | 12.36 | 33.81 | 11.71 | 94.7 |
| Comparative Example 3 | 80 | 12.07 | 11.83 | 33.44 | 9.83 | 83.0 |
| Comparative Example 4 | 80 | 11.91 | 12.12 | 32.59 | 9.84 | 81.2 |
| Example 3 | 120 | 11.73 | 8.30 | 29.97 | 7.86 | 94.6 |
| Comparative Example 5 | 120 | 11.64 | 7.91 | 29.74 | 6.53 | 82.5 |
| Comparative Example 6 | 120 | 11.37 | 8.20 | 29.08 | 6.72 | 82.0 |
| Example 4 | 150 | 11.22 | 6.16 | 26.84 | 5.77 | 93.5 |
| Comparative Example 7 | 150 | 11.20 | 5.82 | 26.60 | 4.81 | 82.7 |
| Comparative Example 8 | 150 | 11.01 | 5.92 | 26.02 | 4.75 | 80.2 |
| Example 5 | 200 | 10.17 | 3.10 | 18.09 | 2.83 | 91.1 |
| Comparative Example 9 | 200 | 10.11 | 2.76 | 15.26 | 2.19 | 79.5 |
| Comparative Example 10 | 200 | 10.01 | 3.04 | 15.93 | 2.35 | 77.4 |

As shown in Table 1, the magnetic characteristics of the rare earth magnets on which the plating layer was formed using the element Co were measured at temperatures of 20° C., 80° C., 120° C., 150° C., and 200° C., and converted into numerical values in the case of Examples 1 to 5.

The magnetic characteristics of the rare earth magnets on which no plating layer was formed were measured at temperatures of 20° C., 80° C., 120° C., 150° C., and 200° C., and converted into numerical values in the case of Comparative Examples 1, 3, 5, 7, and 9.

The magnetic characteristics of the rare earth magnets coated with a Ni—Cu—Ni alloy were measured at temperatures of 20° C., 80° C., 120° C., 150° C., and 200° C., and converted into numerical values in the case of Comparative Examples 2, 4, 6, 8, and 10.

Hereinafter, the magnetic characteristics as listed in Table 1 will be described with reference to FIGS. 4 to 8.

Figure 4:
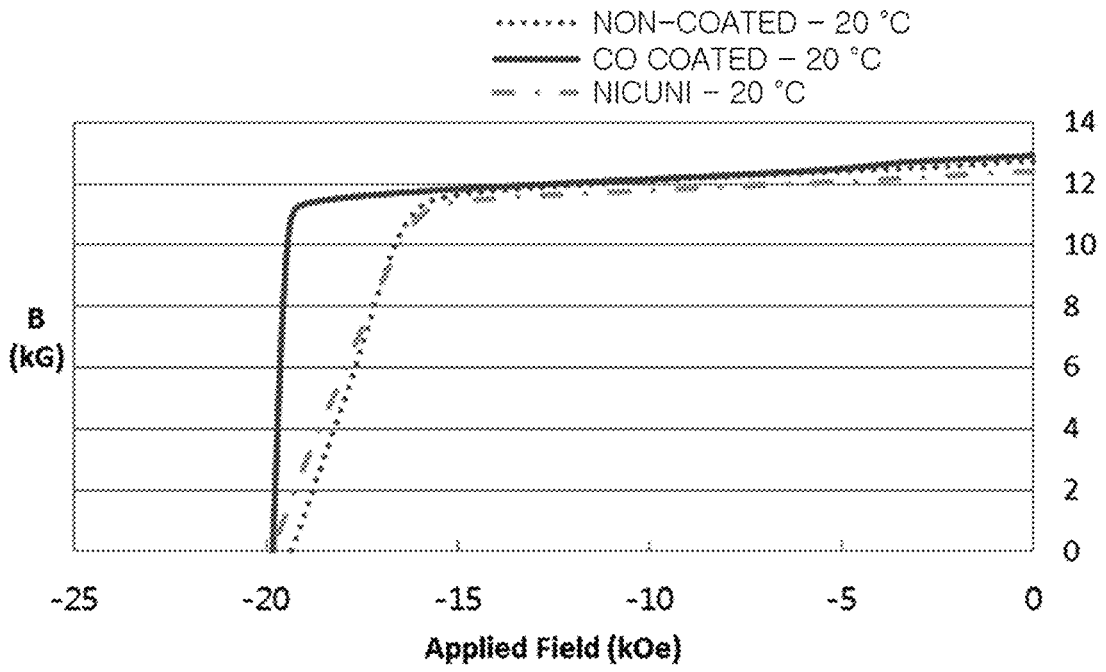
FIGS. 4 to 8 are diagrams for comparing magnetic characteristics of a rare earth magnet according to one exemplary embodiment of the present invention.

Referring to Example 1, Comparative Example 1 and FIG. 4, for the characteristics such as flux density (Br), intrinsic coercive force (Hcj), maximum energy product ((BH)max), and magnetic field (Hk), it could be seen that the magnetic characteristics of the rare earth magnets on which the plating layer was formed using the element Co were superior to those of the rare earth magnets on which no plating layer was formed, and had a magnetic field-coercive force ratio of 86.1%, a measured value which was closer to the ideal value of 1.

Referring to Example 1, Comparative Example 2 and FIG. 4, for the characteristics such as flux density (Br), maximum energy product ((BH)max), and magnetic field (Hk), it could be seen that the rare earth magnets on which the plating layer was formed using the element Co were superior to those of the rare earth magnets coated with a Ni—Cu—Ni alloy, and had a magnetic field-coercive force ratio of 86.1%, a measured value which was closer to the ideal value of 1.

That is, it could be seen that the rare earth magnets on which the plating layer was formed using the element Co had a magnetic field-coercive force ratio of 0.86 or more in a temperature range from 20° C. to less than 80° C., and thus had a magnetic field-coercive force ratio 0.05 or more above those of the rare earth magnets on which no plating layer was formed, and also had a magnetic field-coercive force ratio 0.07 or more above those of the rare earth magnets coated with a Ni—Cu—Ni alloy.

Figure 5:
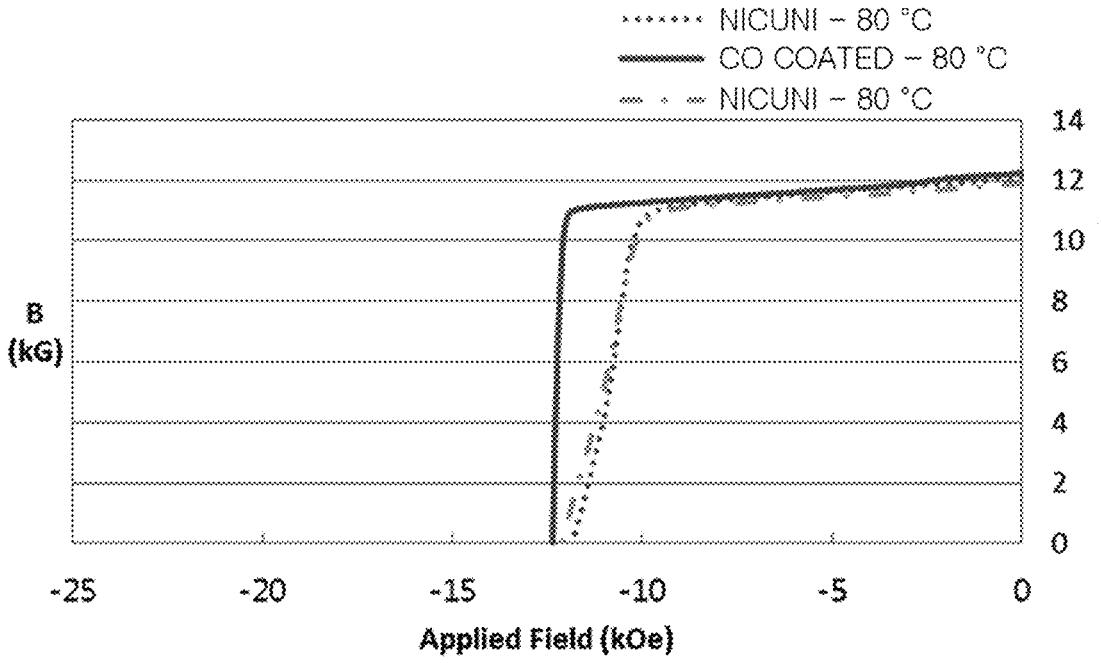

Referring to Example 2, Comparative Example 3 and FIG. 5, for the characteristics such as flux density (Br), intrinsic coercive force (Hcj), maximum energy product ((BH)max), and magnetic field (Hk), it could be seen that the magnetic characteristics of the rare earth magnets on which the plating layer was formed using the element Co were superior to those of the rare earth magnets on which no plating layer was formed, and had a magnetic field-coercive force ratio of 94.7%, a measured value which was closer to the ideal value of 1.

Referring to Example 2, Comparative Example 4 and FIG. 5, for the characteristics such as flux density (Br), intrinsic coercive force (Hcj), maximum energy product ((BH)max), and magnetic field (Hk), it could be seen that the magnetic characteristics of the rare earth magnets on which the plating layer was formed using the element Co were superior to those of the rare earth magnets coated with a Ni—Cu—Ni alloy, and had a magnetic field-coercive force ratio of 94.7%, a measured value which was closer to the ideal value of 1.

That is, it could be seen that the rare earth magnets on which the plating layer was formed using the element Co had a magnetic field-coercive force ratio of 0.94 or more in a temperature range from 80° C. to less than 120° C., and thus had a magnetic field-coercive force ratio 0.11 or more above those of the rare earth magnets on which no plating layer was formed, and also had a magnetic field-coercive force ratio 0.135 or more above those of the rare earth magnets coated with a Ni—Cu—Ni alloy.

Figure 6:
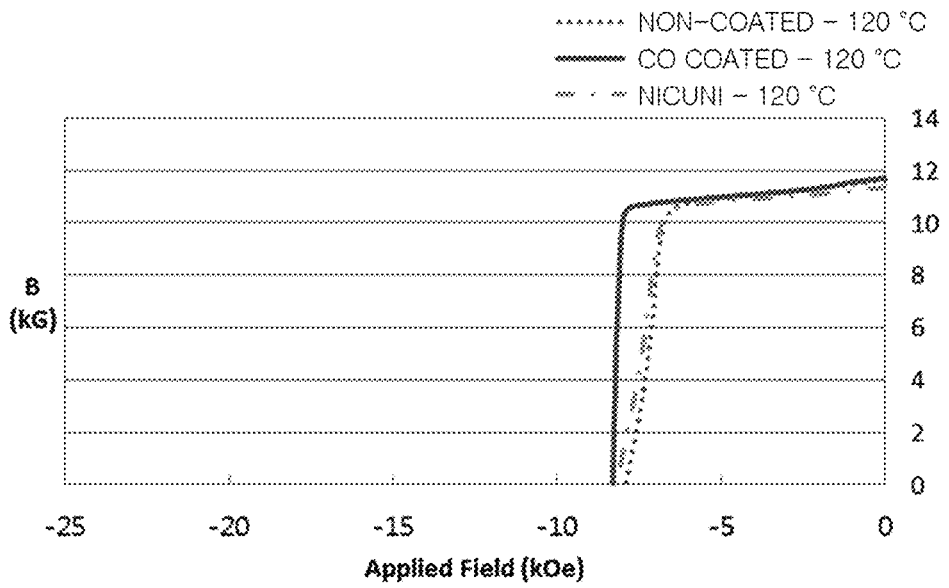

Referring to Example 3, Comparative Example 5 and FIG. 6, for the characteristics such as flux density (Br), intrinsic coercive force (Hcj), maximum energy product ((BH)max), and magnetic field (Hk), it could be seen that the magnetic characteristics of the rare earth magnets on which the plating layer was formed using the element Co were superior to those of the rare earth magnets on which no plating layer was formed, and had a magnetic field-coercive force ratio of 94.6%, a measured value which was closer to the ideal value of 1.

Referring to Example 3, Comparative Example 6 and FIG. 6, for the characteristics such as flux density (Br), intrinsic coercive force (Hcj), maximum energy product ((BH)max), and magnetic field (Hk), it could be seen that the magnetic characteristics of the rare earth magnets on which the plating layer was formed using the element Co were superior to those of the rare earth magnets coated with a Ni—Cu—Ni alloy, and had a magnetic field-coercive force ratio of 94.6%, a measured value which was closer to the ideal value of 1.

That is, it could be seen that the rare earth magnets on which the plating layer was formed using the element Co had a magnetic field-coercive force ratio of 0.93 or more in a temperature range from 120° C. to less than 150° C., and thus had a magnetic field-coercive force ratio 0.121 or more above those of the rare earth magnets on which no plating layer was formed, and also had a magnetic field-coercive force ratio 0.126 or more above those of the rare earth magnets coated with a Ni—Cu—Ni alloy.

Figure 7:
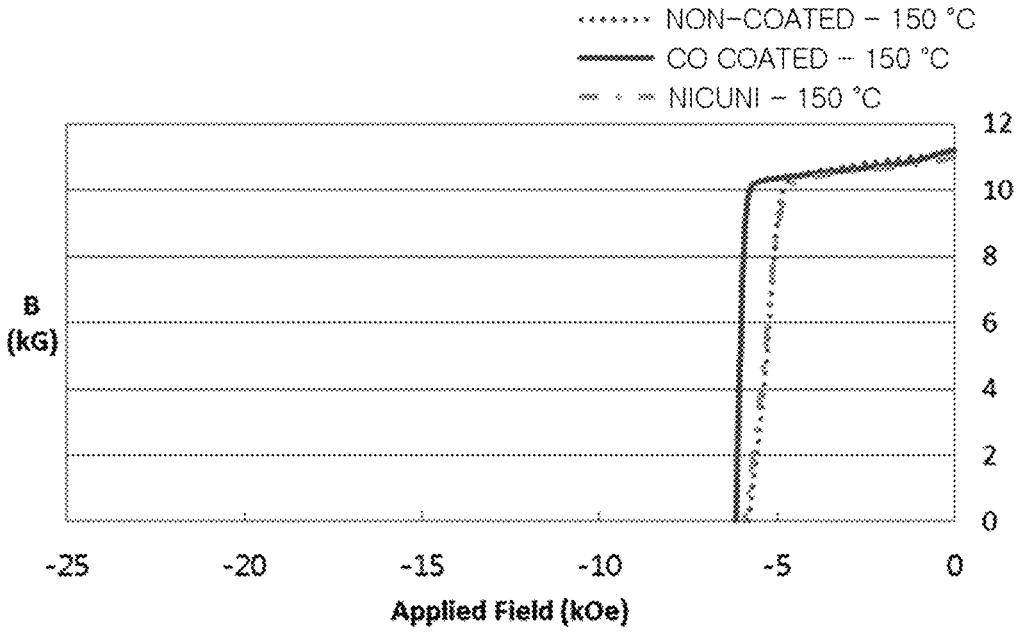

Referring to Example 4, Comparative Example 7 and FIG. 7, for the characteristics such as flux density (Br), intrinsic coercive force (Hcj), maximum energy product ((BH)max), and magnetic field (Hk), it could be seen that the magnetic characteristics of the rare earth magnets on which the plating layer was formed using the element Co were superior to those of the rare earth magnets on which no plating layer was formed, and had a magnetic field-coercive force ratio of 93.5%, a measured value which was closer to the ideal value of 1.

Referring to Example 4, Comparative Example 8 and FIG. 7, for the characteristics such as flux density (Br), intrinsic coercive force (Hcj), maximum energy product ((BH)max), and magnetic field (Hk), it could be seen that the magnetic characteristics of the rare earth magnets on which the plating layer was formed using the element Co were superior to those of the rare earth magnets coated with a Ni—Cu—Ni alloy, and had a magnetic field-coercive force ratio of 93.5%, a measured value which was closer to the ideal value of 1.

That is, it could be seen that the rare earth magnets on which the plating layer was formed using the element Co had a magnetic field-coercive force ratio of 0.90 or more in a temperature range from 150° C. to less than 220° C., and thus had a magnetic field-coercive force ratio 0.108 or more above those of the rare earth magnets on which no plating layer was formed, and also had a magnetic field-coercive force ratio 0.133 or more above those of the rare earth magnets coated with a Ni—Cu—Ni alloy.

Figure 8:
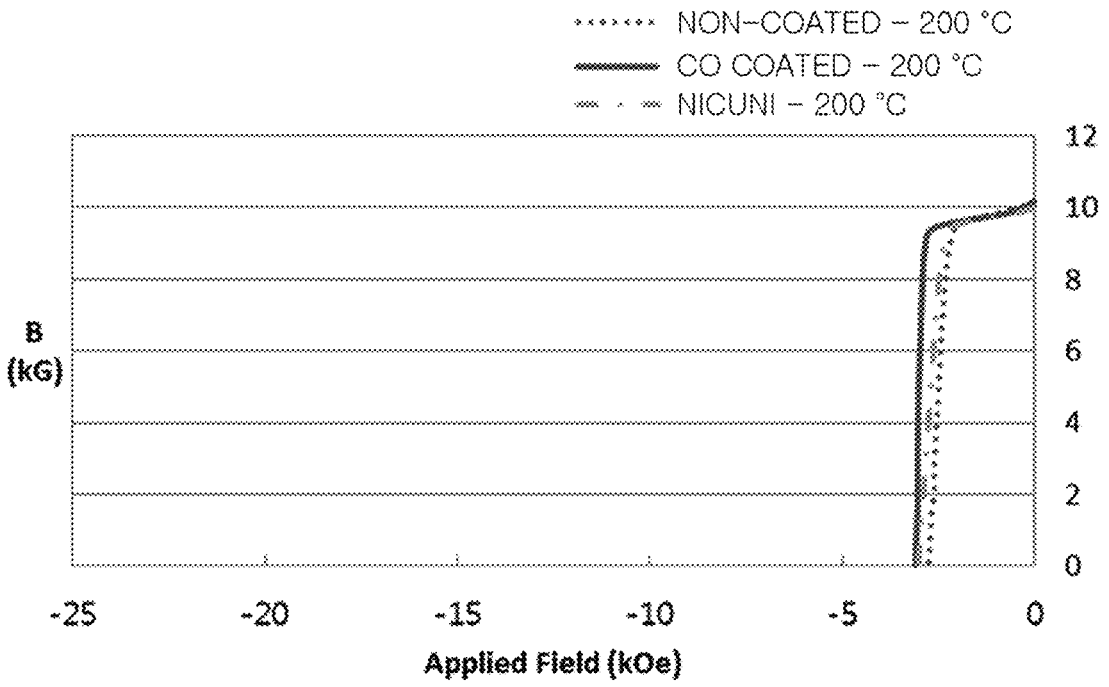

Referring to Example 5, Comparative Example 9 and FIG. 8, for the characteristics such as flux density (Br), intrinsic coercive force (Hcj), maximum energy product ((BH)max), and magnetic field (Hk), it could be seen that the magnetic characteristics of the rare earth magnets on which the plating layer was formed using the element Co were superior to those of the rare earth magnets on which no plating layer was formed, and had a magnetic field-coercive force ratio of 91.1%, a measured value which was closer to the ideal value of 1.

Referring to Example 5, Comparative Example 10 and FIG. 8, for the characteristics such as flux density (Br), intrinsic coercive force (Hcj), maximum energy product ((BH)max), and magnetic field (Hk), it could be seen that the magnetic characteristics of the rare earth magnets on which the plating layer was formed using the element Co were superior to those of the rare earth magnets coated with a Ni—Cu—Ni alloy, and had a magnetic field-coercive force ratio of 91.1%, a measured value which was closer to the ideal value of 1.

As seen from the numerical values measured as listed in Table 1 and shown FIGS. 4 to 8, it could be seen that the magnetic characteristics of the rare earth magnets on which the plating layer was formed using the element Co were superior to those of the rare earth magnets on which no plating layer was formed and the rare earth magnets coated with a Ni—Cu—Ni alloy in the whole temperature range prior to the measurement. Also, it could be seen that the high-temperature demagnetization characteristics of the rare earth magnets on which the plating layer was formed using the element Co were improved.

Figure 9:
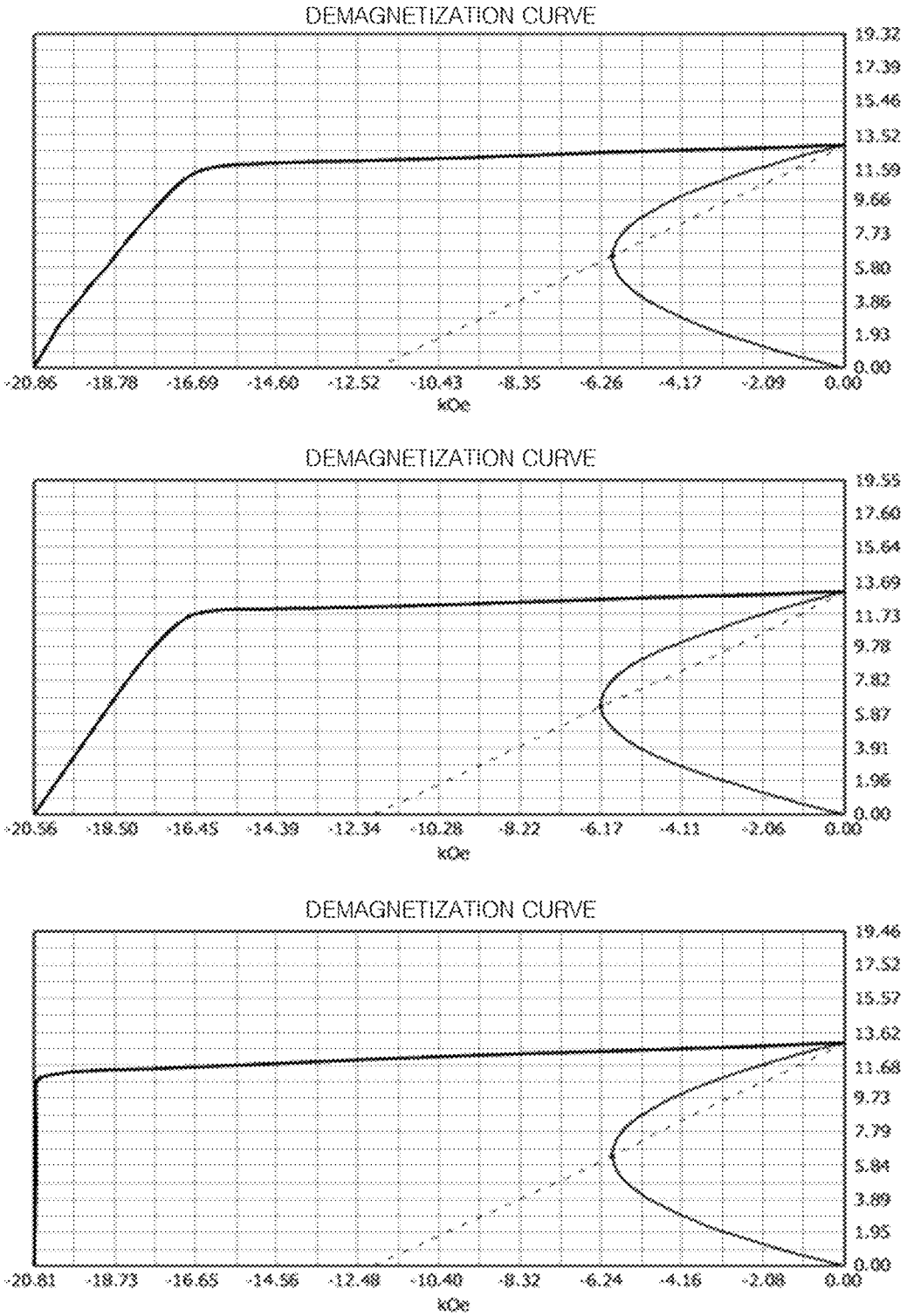
FIG. 9 is a diagram for describing a demagnetization curve for the rare earth magnet according to one exemplary embodiment of the present invention.

FIG. 9 is a diagram for describing a demagnetization curve for the rare earth magnet according to one exemplary embodiment of the present invention. Referring to FIG. 9, it could be seen that the rare earth magnet (bottom panel) on which the plating layer was formed using the element Co had squareness close to a right angle, compared to the rare earth magnet (top panel) on which no plating layer was formed and the rare earth magnet (middle panel) coated with a Ni—Cu—Ni alloy, and was formed at a squareness ratio close to 1.

Figure 10:
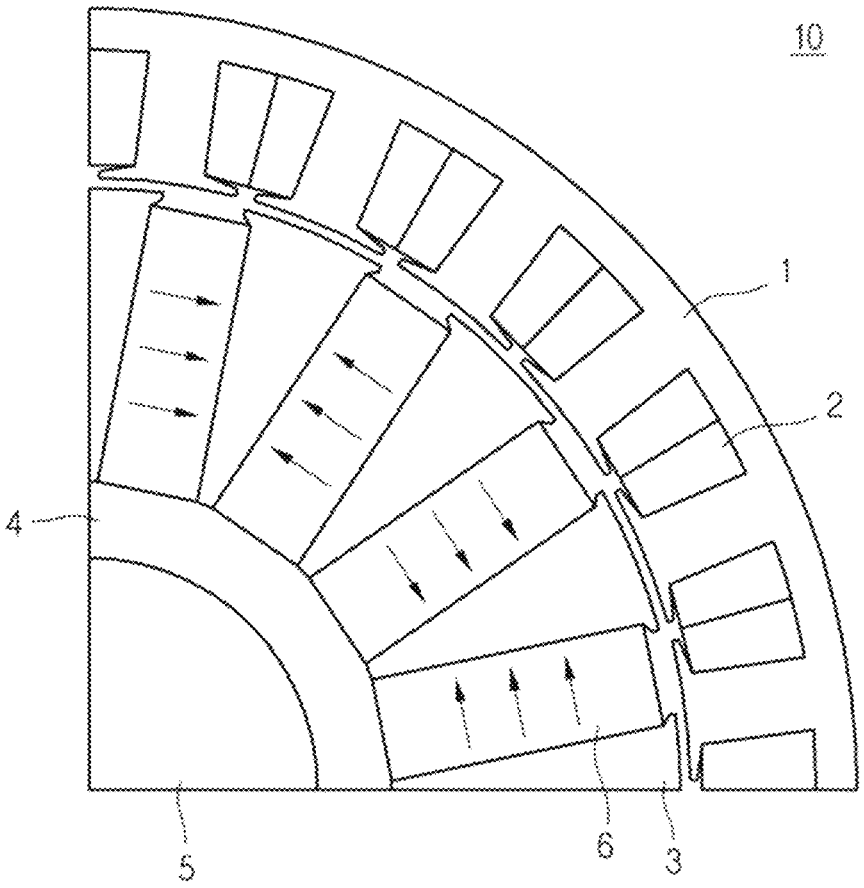
FIG. 10 is a diagram showing a motor according to one exemplary embodiment of the present invention.

FIG. 10 is a diagram showing a motor according to one exemplary embodiment of the present invention.

Referring to FIG. 10, the motor 10 according to one exemplary embodiment of the present invention includes a stator 1 formed in a cylindrical shape, and a rotor 3 rotatably accommodated in the stator 1.

The rotor 3 is manufactured by stacking a plurality of magnetic steel sheets with the same shape to form a rotor core, and a pivot hole is axially formed in a central region of the rotor core. As a result, a shaft 5 is press-fitted into the pivot hole to rotate with the rotor 3. A non-magnetic substance 4 configured to concentrate the magnetic flux is formed between the shaft 5 and the rotor 3.

Holes are formed outside the central region of the rotor core to insert and attach a plurality of rare earth magnets 6 in a circumferential direction.

The stator 1 includes a ring-type core, a plurality of teeth spaced apart from each other in a circumferential direction with predetermined slots sandwiched therebetween in an inner circumferential surface of the ring-type core, and a coil 2 wound around the teeth to be connected to an external power source.

Meanwhile, the permanent rare earth magnets 6 may be formed so that a repulsive force is formed between the neighboring rare earth magnets 6, and a plating layer of the element Co may be formed on a surface of each of the rare earth magnets 6 by an electroplating method, thereby maintaining excellent magnetic characteristics.

Also, heat may be generated at the stator 1 and the rotor 3 due to a high output density when the rotor 3 rotates at a high speed. As a result, the output characteristics of the motor 10 may be maintained since the magnetic characteristics are not degraded.

The rare earth magnet according to one exemplary embodiment of the present invention and the motor including the same can be useful in improving magnetic characteristics, particularly in improving high-temperature demagnetization performance in which the magnetic characteristics are degraded at a high temperature.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A rare earth magnet based on an R-iron (Fe)-boron (B) alloy (R represents at least one rare-earth element comprising Y), wherein a plating layer of element Co is directly formed on a surface of the rare earth magnet by an electroplating method, wherein a ratio of Hk (Hk is a magnetic field at 0.9 Br, Br is a residual magnetic flux density) to a coercive force of the rare earth magnet (Hk/HcJ) at a temperature between 80° C. and less than 200° C. is greater than or equal to 0.90, wherein the rare earth magnet includes an additional element selected from the group consisting of titanium (Ti), vanadium (V), chromium (Cr), manganese (Mn), bismuth (Bi), niobium (Nb), tantalum (Ta), molybdenum (Mo), tungsten (W), antimony (Sb), germanium (Ge), tin (Sn), zirconium (Zr), nickel (Ni), silicon (Si), gallium (Ga), and hafnium (Hf), and wherein a content of the additional element is greater than 0 atom percent and less than 3 atom percent, and wherein the content of R is 35-40 atom percent based on a total content of the rare earth magnet.

2. The rare earth magnet of claim 1, wherein the plating layer contains the element Co at a content of 98% by weight or more.

3. The rare earth magnet of claim 1, wherein the plating layer of the element Co has a thickness of 10 μm to 45 μm.

4. The rare earth magnet of claim 1, wherein the plating layer of the element Co is formed by applying a direct current power source to a Co plating solution and subjecting the rare earth magnet to surface treatment.

5. The rare earth magnet of claim 4, wherein the direct current power source is applied using the Co plating solution as an anode.

6. The rare earth magnet of claim 1, wherein a content of the boron in the rare earth magnet is in a range of 2 to 28 atom percent.

7. The rare earth magnet of claim 1, wherein the ratio of Hk of the magnetic field to the coercive force of the rare earth magnet at a temperature between 80° C. and less than 120° C. is greater than or equal to 0.94.

8. The rare earth magnet of claim 1, wherein the ratio of Hk of the magnetic field to the coercive force of the rare earth magnet at a temperature between 120° C. and less than 150° C. is greater than or equal to 0.93.

9. The rare earth magnet of claim 1, wherein the ratio of Hk of the magnetic field to the coercive force of the rare earth magnet at a temperature between 150° C. and less than 200° C. is greater than or equal to 0.90.

10. The rare earth magnet of claim 1, wherein the plating layer entirely surrounds a surface of the rare earth magnet.

11. The rare earth magnet of claim 10, wherein the residual magnetic flux density (Br) of the rare earth magnet at a temperature between 80° C. and less than 200° C. is between 10 and 12.26 kilo-Gauss (kG).

12. The rare earth magnet of claim 1, wherein the residual magnetic flux density (Br) of the rare earth magnet at a temperature between 80° C. and less than 200° C. is between 10 and 12.26 kilo-Gauss (kG).

13. The rare earth magnet of claim 12, wherein the plating layer entirely surrounds a surface of the rare earth magnet.

14. A rare earth magnet based on an R-iron (Fe)-boron (B) alloy (R represents at least one rare-earth element comprising Y), wherein a plating layer of element Co is directly formed on a surface of the rare earth magnet by an electroplating method, wherein a ratio of Hk (Hk is a magnetic field at 0.9 Br, Br is a residual magnetic flux density) to a coercive force of the rare earth magnet (Hk/HcJ) at a temperature between 80° C. and less than 200° C. is greater than or equal to 0.90, wherein the rare earth magnet includes an additional element selected from group consisting of titanium (Ti), vanadium (V), chromium (Cr), manganese (Mn), bismuth (Bi), niobium (Nb), tantalum (Ta), molybdenum (Mo), tungsten (W), antimony (Sb), germanium (Ge), tin (Sn), zirconium (Zr), nickel (Ni), silicon (Si), gallium (Ga), and hafnium (Hf), and wherein a content of the additional element is greater than 0 atom percent and less than 3 atom percent, wherein the content of R is 35-40 atom percent based on a total content of the rare earth magnet, wherein the plating layer entirely surrounds a surface of the rare earth magnet, and wherein the residual magnetic flux density (Br) of the rare earth magnet at a temperature between 80° C. and less than 200° C. is between 10 and 12.26 kilo-Gauss (kG).

* * * * *